United States Patent [19]

Rubin

[11] 4,150,741

[45] Apr. 24, 1979

[54] COIN-OPERATED APPARATUS FOR CUTTING PRODUCT UNITS FROM A STRIP THEREOF

[76] Inventor: Gino Rubin, Via Boncompagni 55, Milan, Italy

[21] Appl. No.: 790,733

[22] Filed: Apr. 25, 1977

[30] Foreign Application Priority Data

Sep. 15, 1976 [IT] Italy ..... 27214/76

[51] Int. Cl.[2] ..... G07F 5/00; G07F 11/72

[52] U.S. Cl. ..... 194/79; 221/30; 221/71; 83/205; 83/257; 83/278

[58] Field of Search ..... 221/30; 194/79; 221/69, 221/70, 71, 72; 83/205, 257, 278, 92 SR

[56] References Cited

U.S. PATENT DOCUMENTS

| | | | |
|---|---|---|---|
| 1,813,934 | 7/1931 | Knee | 312/94 X |
| 3,179,288 | 4/1965 | Davy | 221/30 X |
| 3,984,030 | 10/1976 | Morini | 221/30 |

FOREIGN PATENT DOCUMENTS

| | | | |
|---|---|---|---|
| 2643188 | 4/1972 | Fed. Rep. of Germany | 221/71 |

*Primary Examiner*—Allen N. Knowles

*Attorney, Agent, or Firm*—Pollock, Vande Sande & Priddy

[57] ABSTRACT

This invention relates to an apparatus for distributing products by packaging them in individual containers connected together to form a strip, and cutting each individual product unit from the strip which is fed stepwise to being each terminal product unit into a cutting position during each distributing cycle. The apparatus comprises a coin box, a cutting mechanism arranged to separate the terminal product unit from the strip when a token or coin is inserted into the coin box, and a feed mechanism arranged to cause advancing of the strip by one step when the cutting mechanism returns to a rest position.

7 Claims, 7 Drawing Figures

COIN-OPERATED APPARATUS FOR CUTTING PRODUCT UNITS FROM A STRIP THEREOF

Product distribution by automatic or semi-automatic machines operated with coins or tokens is known in the art.

In these machines, an individual product unit is usually delivered either by free fall or by lateral withdrawal from a stack placed in a loader.

This distribution method is suitable for all products easily stacked in a precise manner, but is unsuitable for products which, because of their configuration, are difficult to stack. More precisely, said method is not suitable for products which by their nature and use must be distributed in a form of a pack. A typical example is the disposable toothbrush comprising one dose of toothpaste.

According to the invention, said products are distributed by packaging them in individual containers connected together to form a strip, and cutting each individual product unit from the strip which is fed stepwise to bring each terminal product unit into a cutting position during each distribution cycle.

The apparatus for carrying out the invention comprises, in combination, a coin box which, on inserting therein a suitable token or coin, activates a cutting mechanism arranged to separate the terminal product unit from the strip, with the return to rest position of said cutting mechanism causing a feed mechanism to operate, to feed the strip by one step so as to bring the next product unit into position suitable for cutting, and ready for a further operating cycle.

For the correct operation of the apparatus in question, it has proved particularly important to keep the strip firmly locked, to assure that the terminal product unit becomes located in the exact cutting position, and to control its stepwise feed in such a manner as to prevent imprecise feed strokes which could have damaging consequences and prejudice the integrity of the distributed products.

On this account, a special feed and locking mechanism has been constructed, operationally controlled by the cutting mechanism and constrained thereto.

These and further characteristics, objects and advantages of the invention will be more evident from the description given hereinafter by way of example with reference to the accompanying drawings, which illustrate one preferred embodiment of a semi-automatic distributor according to the invention, and in which.

Figure 1:
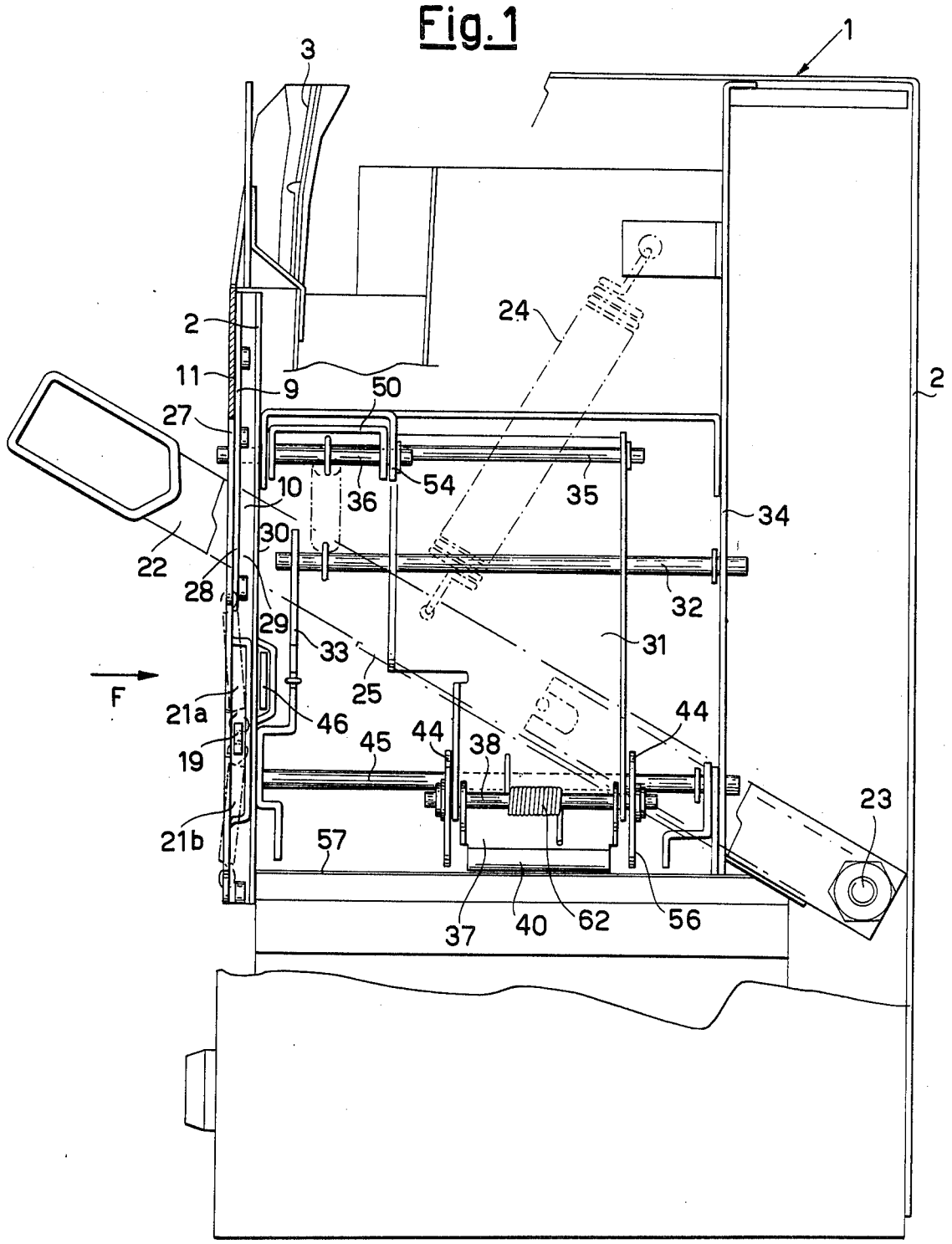
FIG. 1 is a front elevation of said distributor, its casing having been cut away in order to illustrate its working parts.

With reference to the drawings, the semi-automatic distributor according to the invention is indicated overall by 1 and consists structurally of an outer parallelepiped casing 2 containing the working units of the machine which consist essentially of a coin box, a cutting mechanism for the terminal product unit of the strip and a mechanism for stepwise feeding the strip and locking it in the cutting position. These three units operate independently and are each formed from the components described hereinafter.

The coin box is formed from a chute 3 down which the coin or token rolls and guides the coin so that it falls freely in a substantially vertical channel 4. The chute 3 consists of two parallel opposing plates 6 and 7 suitably spaced apart. The plate 7 is rotatable about a pin *7a* and is thrust by a spring *7b* so that its lower edge is urged against the inward bent lower edge of the plate 6 to form a rolling base for the coin. The plates 6 and 7 are bent outwards at the top to form a lead-in for inserting the coin into the chute 3.

Figure 3:
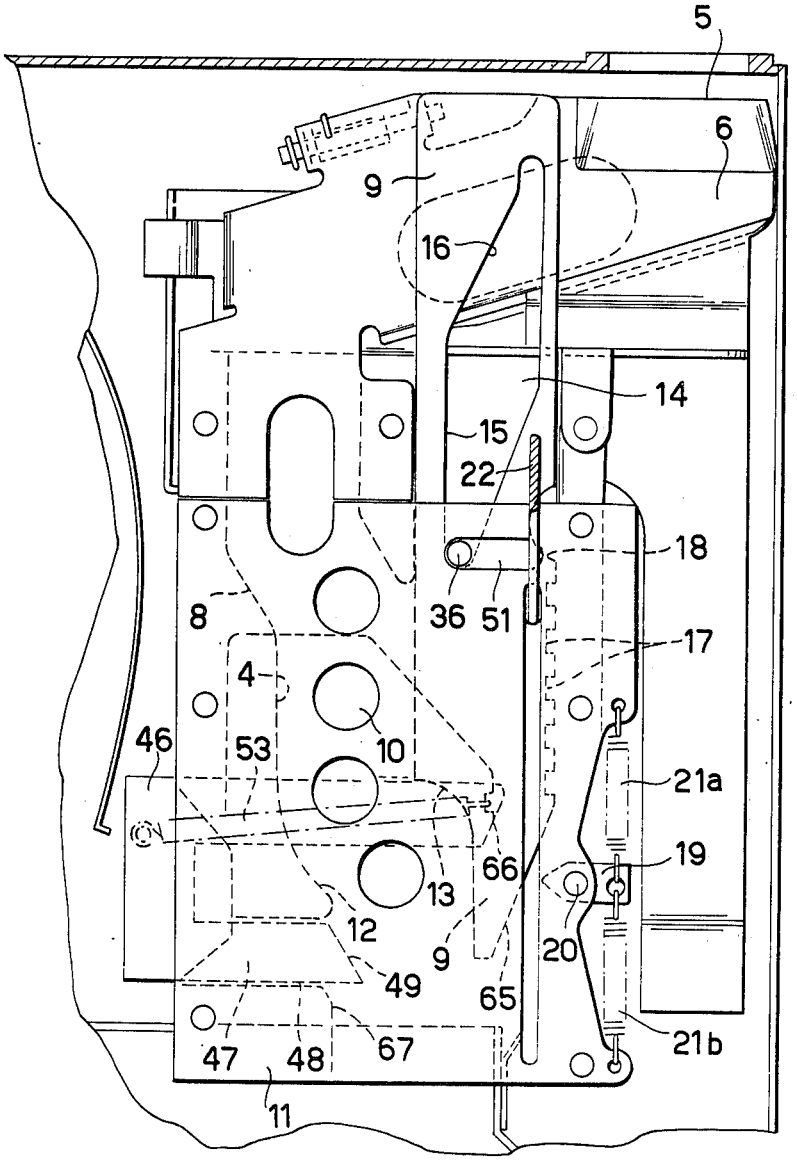
FIG. 3 is a side elevation in the direction of the arrow F of FIG. 1, also partly cut away.

The channel 4 is defined by a rib 8 of a plate 10 and the edge of a bar 9 positioned at a suitable distance between said rear plate 10 and a front plate 11. Bar 9 is movable, and this and rib 8 comprise respective curved profiles 12, 13 at their lower ends, designed to cooperate with the coin, as will be explained hereinafter. Bar 9 comprises a shaped aperture 14 to define a straight guide edge 15 and an inclined guide edge 16 for the end of a pin 36, as will be described hereinafter. The outer edge of the bar 9 comprises a plurality of notches 17 of rectangular shape and a curved notch 18. A pawl 19 pivoted at 20 between the plates 10 and 11 cooperates with said notches 17, 18 in the manner described hereinafter, the pawl 19 being urged by two opposing springs 21*a* and 21*b* to always take up the horizontal position shown in FIG. 3.

Figure 2:
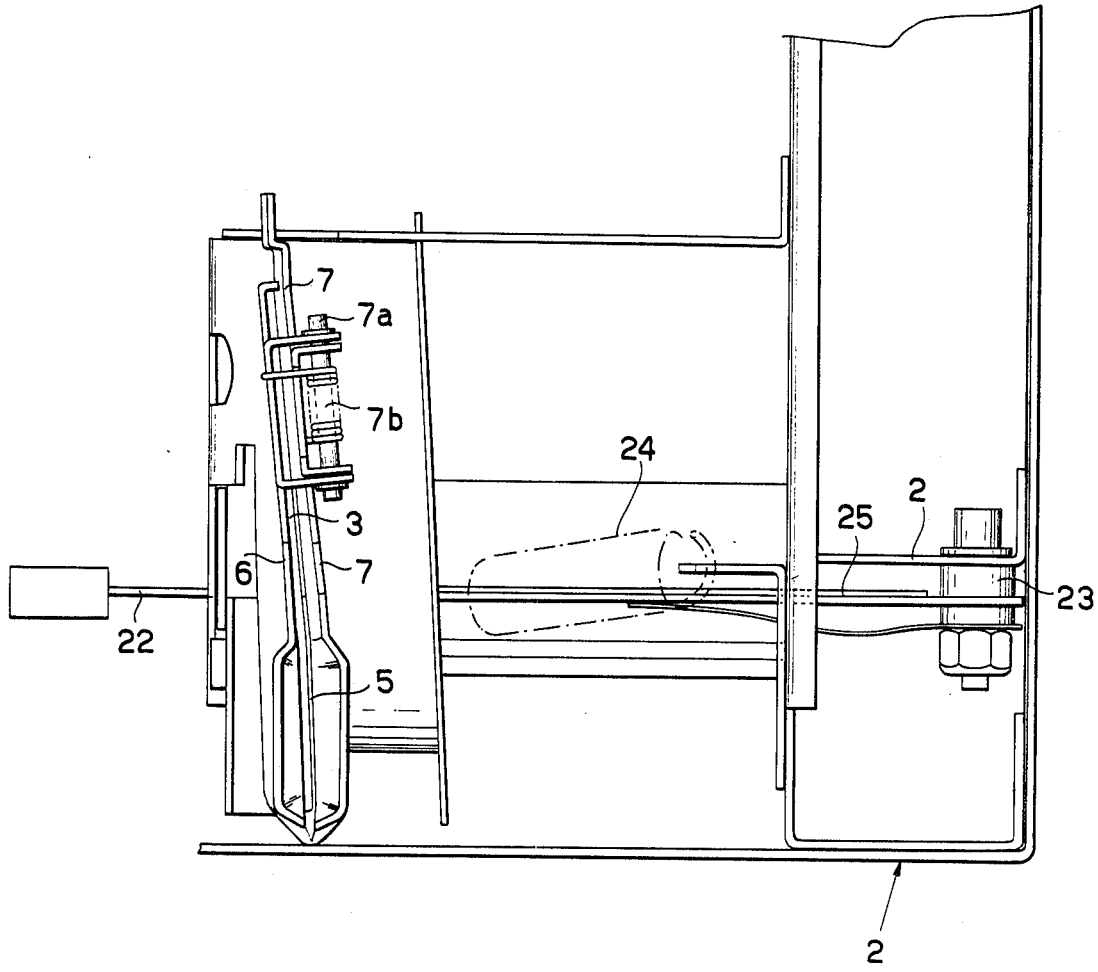
FIG. 2 is a plan view, also partly cut away.
Figure 4:
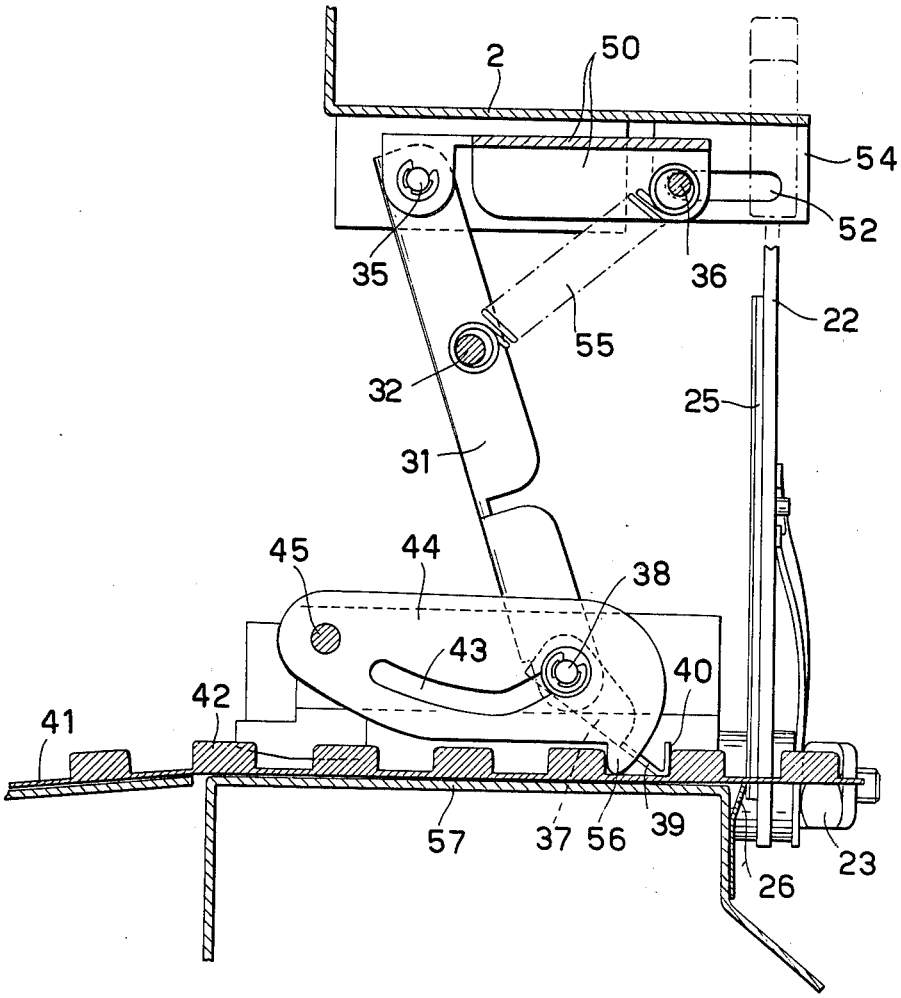
FIGS. 4 and 5 are two detailed views illustrating the working positions of the strip feed and locking mechanism.
Figure 5:
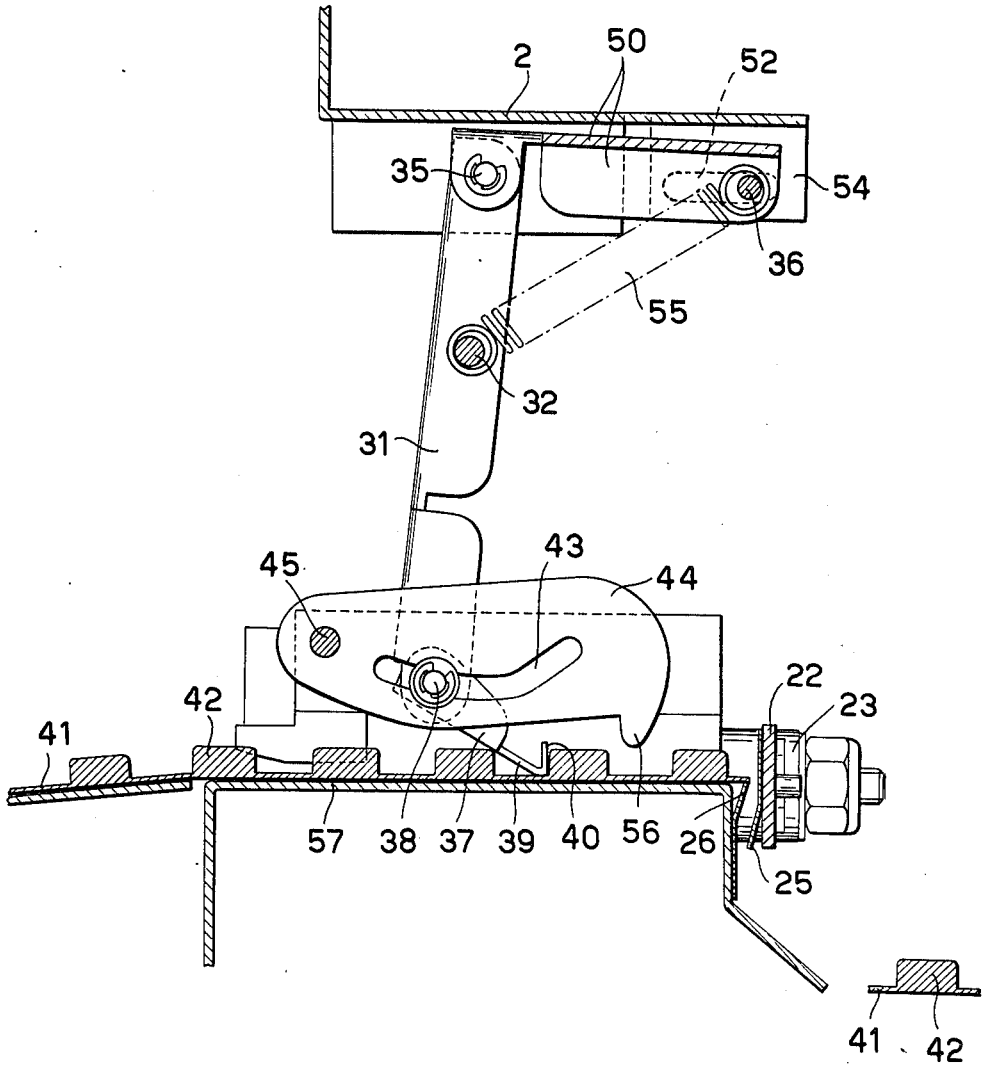

The cutting mechanism is formed from a lever knife 22 rotatably pivoted at 23 to the casing (FIGS. 1 and 2). A spring 24 tends to keep said knife 22 always in the raised position of FIG. 1. The knife has a blade 25 cooperating with a fixed counter-blade 26 (FIGS. 4 and 5). As can be seen in FIG. 1, knife 22 emerges from casing 2 passing through four slots 27, 28, 29 and 30 provided respectively in plate 11, bar 9, plate 10 and casing 2. Slots 27, 29 and 30 have a length such as to enable knife 22 to move freely from the raised position to lowered position. Slot 28 in the bar 9 has a height such that knife 22 can only just pass through, and the bar 9 and knife 22 are thus interconnected via slot 28.

Figure 6:
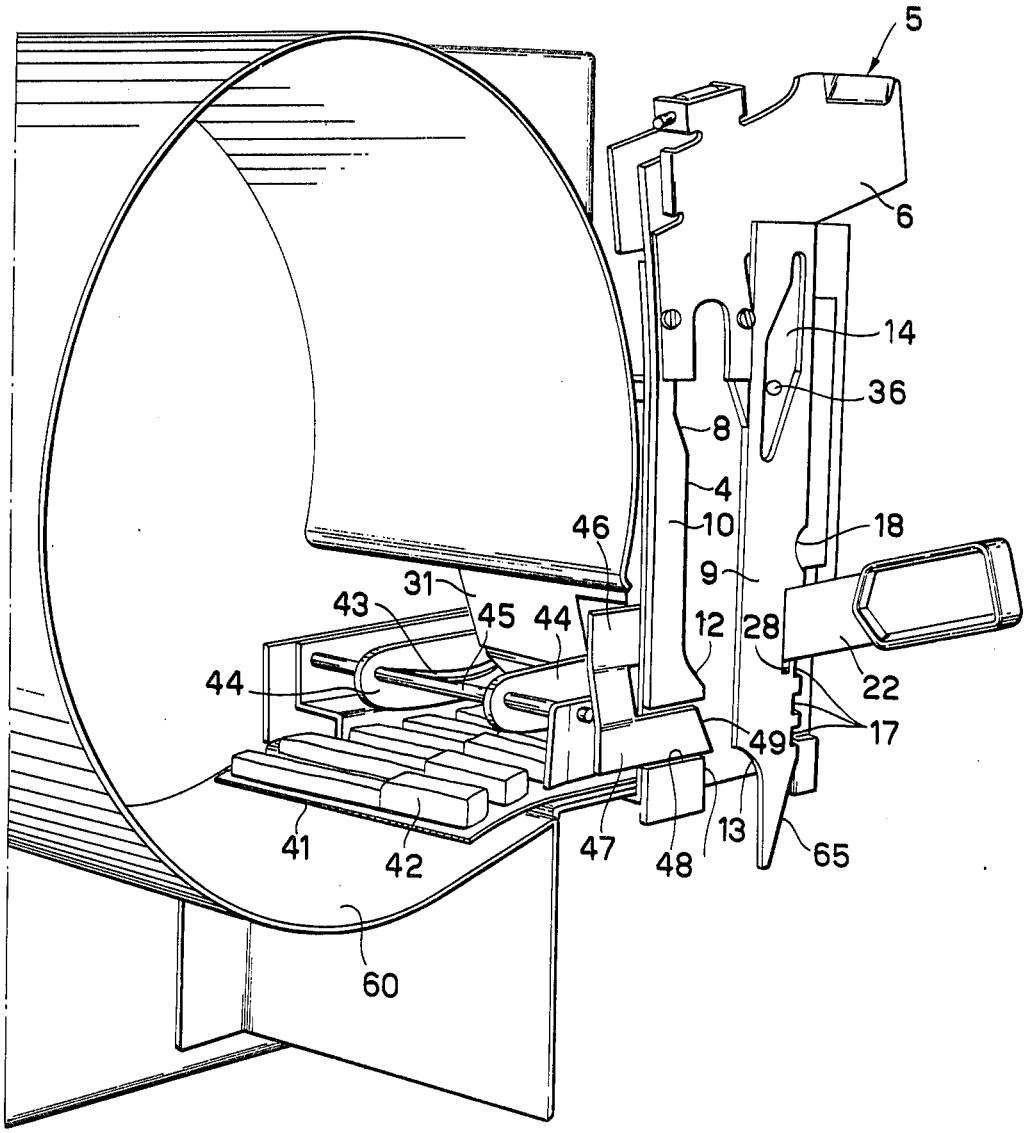
FIG. 6 is a perspective view showing the distributor without its outer casing.

A device cooperates with knife 22 to lock it against lowering, and consists of a latch 46 which is movable, as will be explained hereinafter, between two end positions, namely a position which intersects and a position which does not intersect trajectory of the knife 22. Latch 46 is located behind rear plate 10 (FIGS. 1, 3 and 6) and comprises a tongue 47 inserted between plates 10, 11 in a guide 48 provided between the bottom of rib 8 and a rib 67 of the plate 10. The end of tongue 47 is bevelled at 49 to cooperate with the coin or token. As can be seen in FIG. 6, said tongue 47 is formed in one piece with latch 46 and is parallel to it. A spring 53 tends to keep latch 46 always in the position in which it locks knife 22.

The stepwise feed mechanism for the strip comprises a box lever 31 swivel pivoted by a pin 32 on a fixed support 33 and a shoulder 34 of the machine. Said lever 31 is connected by a pin 35 extending horizontally in the direction of support 33, to a slide 50 of inverted U shape which carries at its free end a pin 36 guided in superimposed slots 51 in plates 10 and 11 and in casing 2, and in a parallel slot 52 in a fixed support 54, pin 56 being inserted by one of its ends into the aperture 14 in bar 9 to cooperate with the edges 15, 16 of said aperture. A spring 55 acting between pins 32 and 36 tends to keep the slide 50 and box lever 31 in the position shown in FIG. 4, with pin 36 displaced to the left in the slots 51, 52 and disposed on the bottom of aperture 14 in the bar 9.

As can be seen in FIGS. 4 and 5, box lever 31 carries at its lower end a scoop 37 swivel pivoted thereto by a pin 38. Scoop 37 terminates in a tongue 39 with a portion 40 bent upwards, said tongue 39 being designed to cooperate in the manner described hereinafter with strip 41 of containers 42 each containing a product unit.

A torsion spring 62 (FIG. 1) is wound about pin 38 of the scoop 37 to act between pin and scoop and hold this latter tightly against strip 41 sliding on a surface 57. Pin 38 is also guided at its ends in curved slots 43 provided in levers 44 disposed laterally to scoop 37 and swinging about a transverse fixed pin 45. Levers 44 are in the form of teeth 56 at their free ends to engage with containers 42 of the strip 41 (see FIG. 4).

A circular chamber 60, open laterally (FIG. 6), is designed to contain strip 41 wound in the form of a reel (only partly shown).

Figure 7:
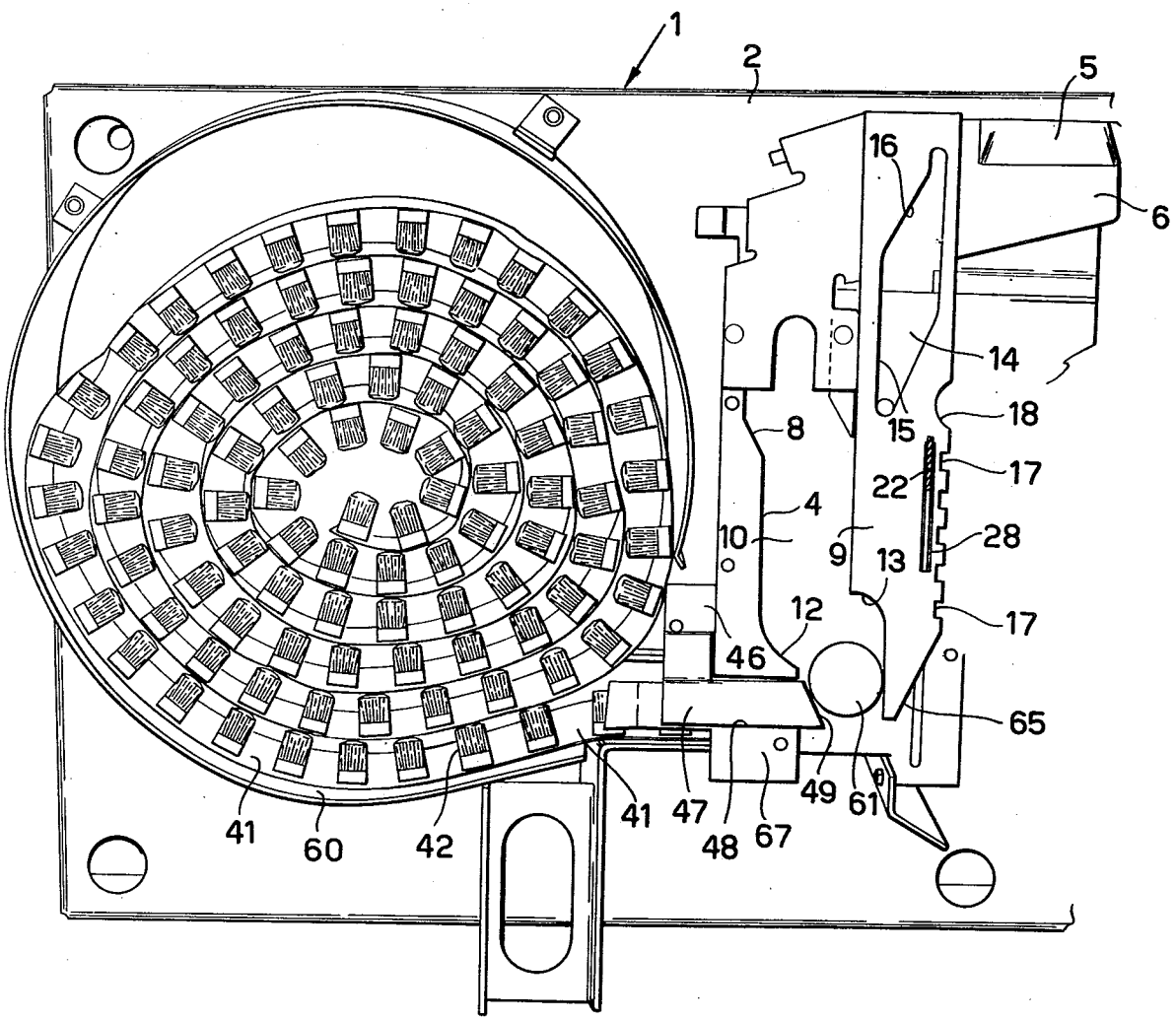
FIG. 7 illustrates the operation of the distributor coin box.

The distributor heretofore described operates in the following manner. When a suitable coin 61 is inserted into the coin box, it rolls along chute 3 and falls down the channel 4 to stop in the position shown in FIG. 7, i.e., between the bevelled end 49 of tongue 47 of the latch 46 and the end of movable bar 9. At this point the user lowers knife 22 which drags with it bar 9 so as to make the curved profile 13 of this latter force coin 61 to slide downwards. Consequently the coin 61 acts on tongue 47 of the latch 46 and, overcoming the action of spring 53, moves it towards the left (see FIGS. 1 and 7). Latch 46 is thus brought outside the trajectory of knife 22, which may be completely lowered to cut the last container 42 from strip 41 (FIG. 5). In the meantime, the coin falls freely into a collection box (not shown) and spring 53 returns latch 46 into the position in which it prevents lowering of knife 22.

During its downward stroke, the knife 22 drags with it bar 9. In a first part of the downward movement, the end of pin 36 is in contact with the straight edge 15 of the aperture 14, while during the last part of the movement the inclined edge 16 of the aperture 14 in bar 9 acts on the pin 36, to move pin 36 to the right in the slots 51 and 52. Consequently slide 50 is also moved, and this causes rotation of box lever 31 about the pin 32 in a clockwise direction against the action of spring 55. Lever 31 is thus moved from the position shown in FIG. 4 to that shown in FIG. 5. During this rotation of box lever 31, the scoop 37 is urged by the penultimate container 42 of strip 41 to rotate in an anticlockwise direction against the action of spring 62 so that it passes over the container and then, urged by spring 62, its tongue 39 moves into the space between the penultimate container and the preceding one (FIG. 5) to make contact with the rear edge of said penultimate container.

During the rotation of box lever 31, the pin 38 carried thereby slides in the curved slots 43 in levers 44 to cause them to rotate to a limited extent about pin 46 so that the teeth 56 are slightly raised (see FIG. 5) and released from engagement with the penultimate container 42 of strip 41.

The user now releases knife 22 which is returned upwards by spring 42. Knife 22 also drags with it the bar 9 so that the end of pin 36, continuously urged by the spring 55, follows the inclined edge 16 of aperture 14 to enable the slide 50 and box lever 31 to return to their initial position.

As box lever 31 rotates under the thrust of the spring 55, it turns into the position shown in FIG. 4, and the scoop of the box lever 31 thrusts strip 41 forward by one step to bring the last container 42 into the cutting position between blade 25 and counter-blade 26 for the next working cycle. Simultaneously levers 44 are rotated so that they again engage by their teeth 56 with the container strip to exactly position it.

It should be noted that knife 22 on returning to its original raised position, encounters the bevelled edge 66 of latch 46 to move it towards the left so that it can pass by. Spring 53 then again moves the latch into the position in which it locks knife 22.

Pawl 19 (FIG. 3) operates as a reversible escapement. In this respect, it is urged by the inclined profile 65 of bar 9 to rotate anticlockwise to enable bar 9 to slide freely downwards independently of notches 17. With the bar lowered, the pawl snaps into curved notch 18 by which it is urged to rotate clockwise when bar 9 is slid upwards. Pawl 19 locks bar 9 and consequently the knife 22 by engaging in one of the notches 17 only if the downward stroke of knife 2 is halted in an intermediate position.

It is evident from the foregoing description that, because of the particular feed and locking mechanism, strip 41 of containers 42 for the product units to be distributed is firmly held by scoop 37 of the lever 31 and by the teeth 56 of the levers 44. These latter release the strip only to allow it to move forward by one step under the action of scoop 37, and then immediately engage with the next container and lock it in the correct position. It is therefore impossible for an excessive or insufficient length of strip 41 to be fed, and the danger of damage to containers 42 when cutting from the strip 41 is thus avoided.

Although a preferred embodiment of the invention has been illustrated and described, it will be evident to experts of the art that numerous variations and modifications may be made thereto without leaving the scope of protection of the invention, defined only by the following claims.

We claim:

1. An apparatus for cutting product units from a strip, wherein said product units are packaged in individual containers connected together to form a strip, and cutting each individual product unit from the strip which is fed stepwise to bring each terminal product unit into a cutting position during each distribution cycle, comprising, in combination, (a) a coin box for insertion therein of a suitable coin, said coin box comprising a coin chute with a restriction defined by an appendix;

(b) a cutting mechanism for separating said terminal product unit from said strip, said cutting mechanism being actuated by insertion of said coin in said coin box;

(c) a latch element movable between a first position in which operation of said cutting mechanism is prevented and a second position in which said operation is permitted, said appendix being connected operationally to said latch element;

(d) a feed mechanism for stepwise feeding of said strip so as to bring the next product unit into a position suitable for cutting, and ready for a further operating cycle, said feed mechanism being actuated by the return to rest position of said cutting mechanism;

(e) whereby a coin inserted into said coin box stops at said restriction to operationally connect said appendix to said cutting mechanism, the operation of said cutting mechanism causing said latch element to move into said second position.

2. An apparatus as claimed in claim 1, wherein said coin chute comprises four walls, two of which are movable relative to each other, one of said movable walls being operationally connected to said cutting mechanism.

3. An apparatus as claimed in claim 1, wherein said feed mechanism comprises a box lever operationally connected to said cutting mechanism and swinging in a longitudinal plane normal to the strip between a first and second position corresponding respectively to the raised and lowered positions of said cutting mechanism, and a scoop which swivels elastically in one direction at the lower end of said box lever and is arranged to engage with each strip container, which causes it to swivel, so that the lowering of the cutting mechanism causes the box lever to rotate into said second position and bring said scoop into engagement with the rear end of the penultimate strip container, while the raising of the cutting mechanism causes the box lever to rotate into said first position such that the scoop exerts a thrust on said container to cause the entire strip to move forward through one step and dispose the last container in the correct position for cutting.

4. An apparatus as claimed in claim 2, wherein said box lever is operationally connected to said cutting mechanism via the same movable wall of the coin chute channel which is operationally connected to said cutting mechanism.

5. An apparatus as claimed in claim 4, wherein said movable wall of coin chute is constituted by a bar comprising a slot for the passage and interconnection of the cutting mechanism, and an aperture with a guide edge which is partly straight and partly inclined to take a pin operationally connected to said box lever and urged by a spring to remain in contact with said guide edge, said bar also comprising a bevelled end to act on said latch element.

6. An apparatus as claimed in claim 3, wherein the pin which carries said scoop which swivels at the lower end of said box lever is guided at its free ends in curved slots provided in two parallel levers disposed to the sides of said scoop and rotating about a fixed pin, said two levers having their free ends in the form of teeth to engage with the front edges of the strip containers so as to lock the strip when the box lever is in said first position.

7. An apparatus as claimed in claim 6, wherein said pin cooperating with the aperture in said movable bar is carried by a slide rotatably connected to the upper end of said box lever, said pin being guided in parallel slots in the frame, and said spring acting between said pin and the fixed rotation pin of said box lever.

* * * * *